United States Patent [19]

Stoyanov

[11] Patent Number: 4,483,087

[45] Date of Patent: Nov. 20, 1984

[54] DISPLAY WITH CHANGEABLE IMAGE AND METHOD OF ITS PRODUCTION

[75] Inventor: Boris P. Stoyanov, Sofia, Bulgaria

[73] Assignee: Glavna Directsia pri Tvorcheski Fond na Sayuza na Bulgarskite Hudojnitsi (SBH), Sofia, Bulgaria

[21] Appl. No.: 337,445

[22] Filed: Jan. 6, 1982

[51] Int. Cl.[3] ..... G09F 19/14; G09F 19/12

[52] U.S. Cl. ..... 40/453; 40/427; 40/616; 40/624

[58] Field of Search ..... 40/427, 431, 442, 443, 40/446, 453, 454, 540, 541, 559, 560, 616, 624

[56] References Cited

U.S. PATENT DOCUMENTS

| | | | |
|---|---|---|---|
| 1,777,866 | 10/1930 | Steiss | 40/453 |
| 2,850,825 | 9/1958 | Grants | 40/453 |
| 3,247,005 | 4/1966 | Parry et al. | 40/624 |
| 3,575,773 | 4/1971 | Courtot | 40/453 |
| 4,124,947 | 11/1978 | Kuhl et al. | 40/453 |

FOREIGN PATENT DOCUMENTS

| | | | |
|---|---|---|---|
| 106830 | 1/1938 | Australia | 40/453 |
| 1129419 | 1/1957 | France | 40/427 |
| 380119 | 9/1932 | United Kingdom | 40/453 |
| 414220 | 8/1934 | United Kingdom | 40/453 |
| 595664 | 1/1948 | United Kingdom | 40/453 |
| 2109606 | 6/1983 | United Kingdom | 40/427 |

*Primary Examiner*—Gene Mancene
*Assistant Examiner*—James Hakomaki

[57] ABSTRACT

A device displaying a changeable image. The device includes a screen having a viewing plane, and platelets thereon. The platelets cast shadows of different sizes. The shadows, when viewed collectively, form images on the viewing plane. The platelets are made of a rigid opaque material and are attached immovably to the viewing plane, the platelets are disposed in parallel rows extending in two mutually perpendicular directions, each forming an angle of 45° with the horizon. The platelets extending in the respective directions are different in both size and shape, such sizes and shapes being determined so as to form a different image in each direction by the shadows cast by the platelets.

3 Claims, 7 Drawing Figures

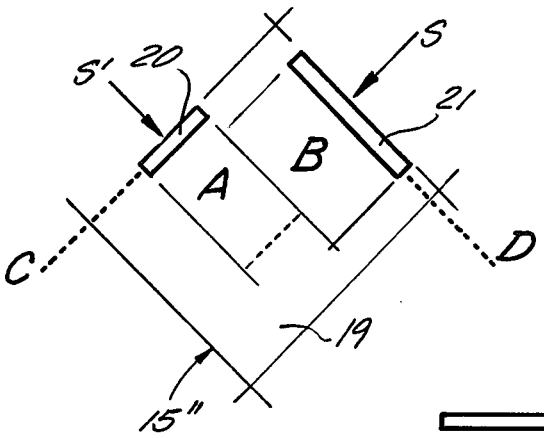
FIG. 4
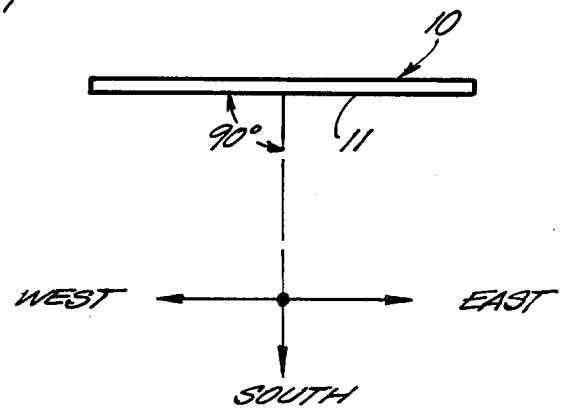
FIG. 5
FIG. 7
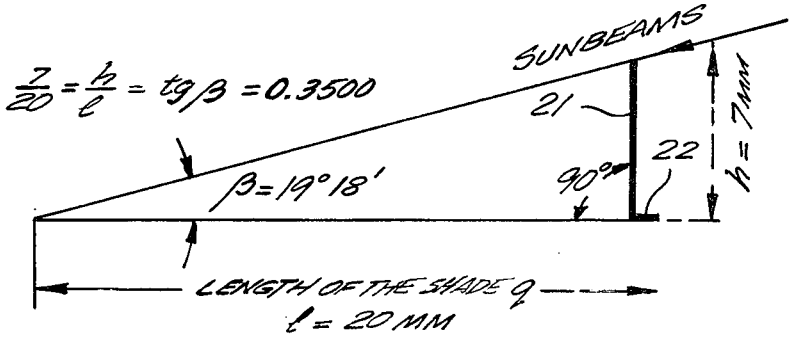

IMAGE I

IMAGE II

DISPLAY WITH CHANGEABLE IMAGE AND METHOD OF ITS PRODUCTION

This invention relates to a display with a changeable image and to the method of its production. The display of the invention is useful in the production of political posters, propaganda, decorations, and advertisements.

It is known to produce a plastic image by creating shady panels by means of spaced geometrical forms; this, however, produces only one image. The disadvantage of such images is their static nature, the complexity of the preparation of spaced geometrical forms, and, most of all, the fact that there is produced only a single image on one and the same viewing plane. The present invention has among its objects the provision of a changeable image and the method of its production, the invention producing two images on one and the same viewing plane. This is accomplished by using relatively simple platelets instead of spaced geometrical forms on the viewing plane.

In accordance with the invention, the changeable image is produced by mounting components for the creation of images by shadows upon a viewing plane, the components being platelets of a rigid nontransparent material. The platelets are fixedly attached to the background or viewing plane and extend perpendicularly thereto; the platelets are mounted in respective rows which extend perpendicular to each other and each of which is disposed at an angle of 45° with respect to the horizontal. The platelets of the respective rows are of different size and shape, such size and shape of the respective platelets being so determined by the shadow formed by each of them forms a respective image extending in the respective one of said directions. The platelets in a preferred embodiment are of L-shape and are attached to the background or viewing plane by one leg forming a foot therefor.

In the method of producing the changeable image, that is, two images on one and the same viewing plane, one must form it from two black and white photographs, which are submitted to screening using a polygraphic screen, and thereafter one must calculate separately the areas of the screen points and set each area equal to the area of a square. The side of the square appears as the length of the base of the platelets, while their heights are obtained analytically. The platelets having sizes thus determined are arranged two at a time, the two such platelets including an angle of 90° therebetween, and being arranged in each screen cell. The area of the shadow projected by the first platelet corresponds to the area of the screen points of the first image, and the area of the screen points of the second image corresponds to the area of the shadow projected by the second platelet of said pair. Depending on the polygraphic originals used, it is possible that on a given screen cell there may be one, two, or no platelets at all.

The main advantages of the changeable images produced by the invention are three:

(1) Such images carry a double amount of information on one and the same viewing plane;

(2) The images are variable in their nature, such variation being produced, not by any mechanical or other device, but as a result of the earth's rotation around its axis (in sunshine) or by the movement of the observer (in conditions of difuse light). During the evening hours of the day, the variation of the images may be obtained by means of a lighting installation, which may be switched on periodically to the left and then the right of the viewing screen bearing the stereoplastic image, respectively;

(3) The changeable image of the invention creates the possibility for producing large-scale images having long service lives.

The invention will be more readily understood upon consideration of the accompanying drawings showing a preferred embodiment of the invention, wherein:

FIG. 4 is a greatly magnified fragmentary frontal view of one cell of the portion of the screen shown in FIG. 3;

FIG. 5 is a view in plan of the display screen showing its orientation in space;

FIG. 7 is a graph illustrating the manner in which the height of the platelets of the stereographic screen are determined.

Figure 1:
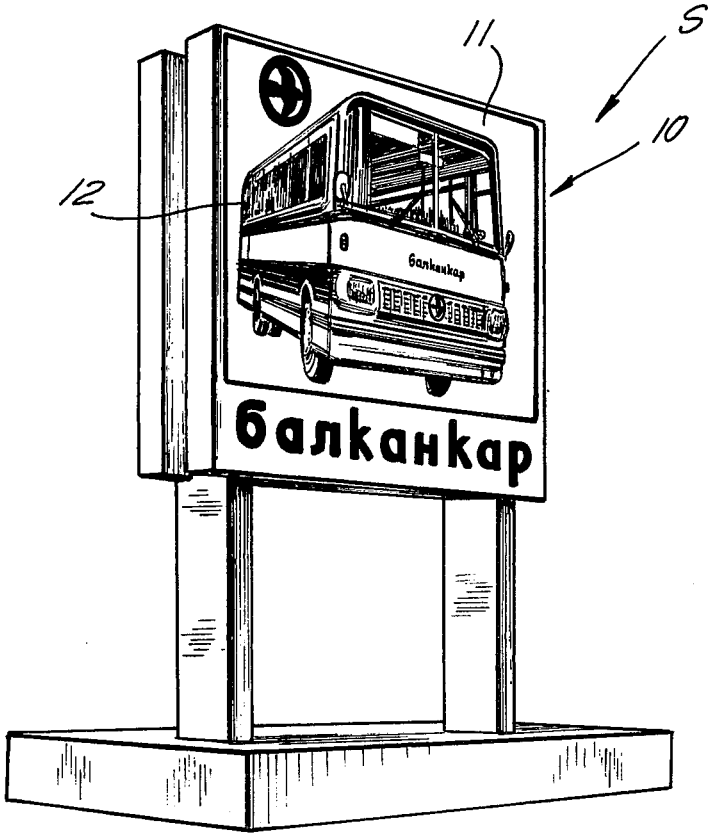
FIG. 1 is a frontal view of the display device of the invention, the light being shown as coming from the upper right so that a first image is displayed by the device.

Turning first to FIG. 1, there is shown a display 10 having a screen 11 on which there is displayed a picture of a bus when the rays S of the sun impinge upon the screen 11 in a direction from above and slanting from right to left.

Figure 2:
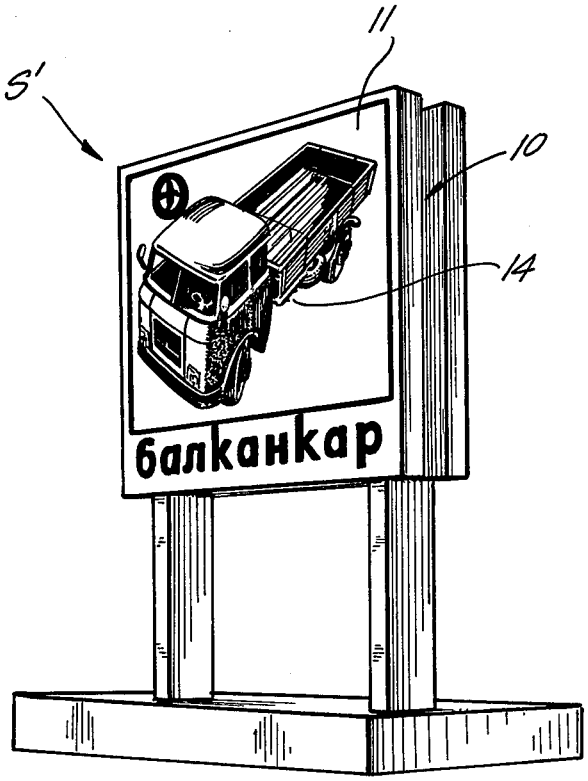
FIG. 2 is a view similar to FIG. 1 but with the light coming from the upper left, the display device then showing a second image.

In FIG. 2 there is shown the same display 10, but in this instance the suns rays are directed from above and from left to right so that a picture 14 of a truck appears on display screen 11.

Figure 3:
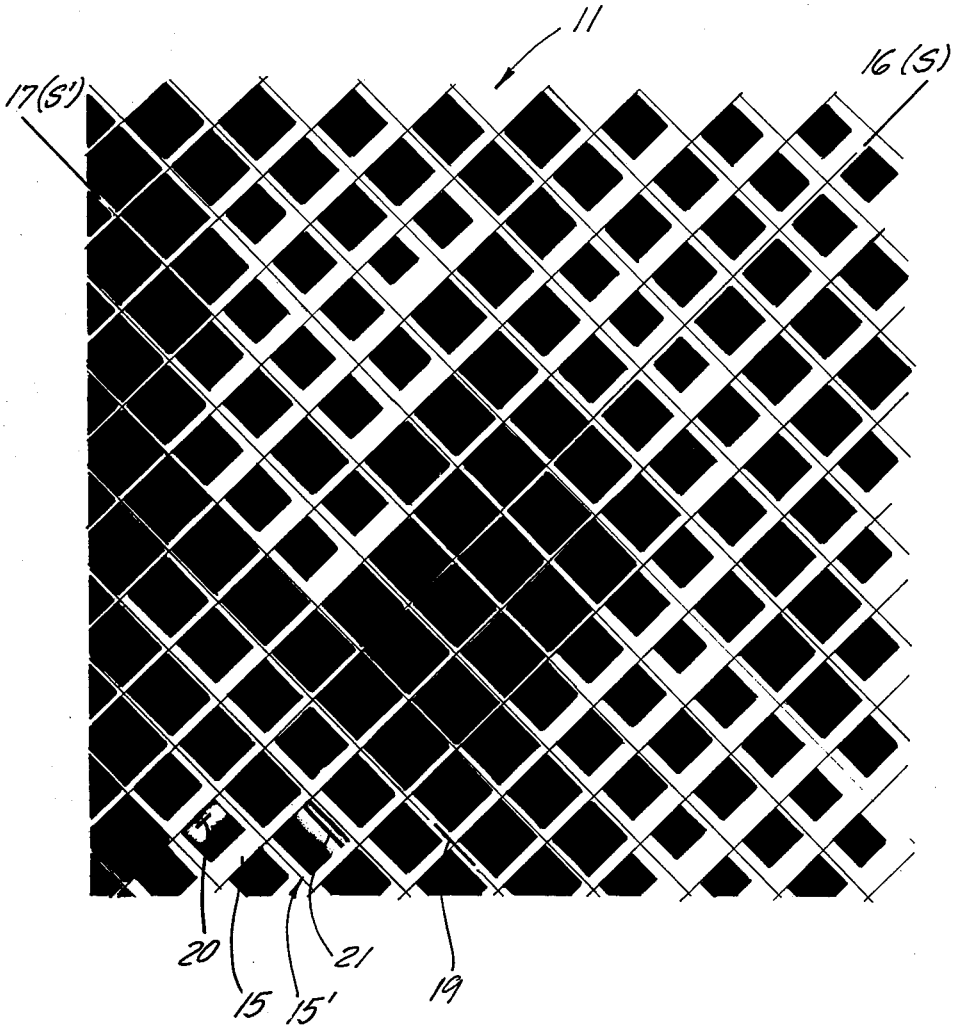
FIG. 3 is a fragmentary frontal view on a large scale of a small part of the changeable display screen in accordance with the invention.

In FIGS. 3 and 4 the structure of the display screen 11 is shown in detail. Turning first to FIG. 3, it will be seen that the screen 11 has on its viewing surface two sets of parallel rows of square cells 15, each cell being common to the two sets thereof, a first set of rows 16 extending downwardly in a direction from right to left and which corresponds generally to the direction S in FIG. 1, and a second set of rows 17 which extend downwardly from left to right at an angle of 45° with respect to the horizontal, such rows extending generally in the same direction as that shown at $S^1$ in FIG. 1.

The display screen 11 has a display surface designated 19 in both FIGS. 3 and 4. In FIGS. 3 and 4 a cell 15 is shown as having a small platelet 20 disposed along the upper edge thereof, and another cell $15^1$ is shown as having a second, larger platelet 21 disposed along its upper edge. It will be apparent that the broad extents of the platelets 20 and 21 are disposed at right angles to each other.

As above explained, an individual cell of the screen may have two, one, or no platelets located therein. In FIG. 4, by way of variation, a further cell $15^{11}$ is illustrated, cell $15^{11}$ having two platelets 20 and 21 located therein. When the suns rays, or other rays of illumination, travel in a path S, the platelet 21 causes a shadow B to be produced upon the background or display surface of the screen 11, the platelet 20 then casting an almost imperceptible shadow C in the form of a line. When rays of illumination directed along the line $S^1$ fall upon the display surface, there is formed a shadow A as a result of the platelet 20, the platelet 21 then forming an almost imperceptible line of shadow D.

Figure 6:
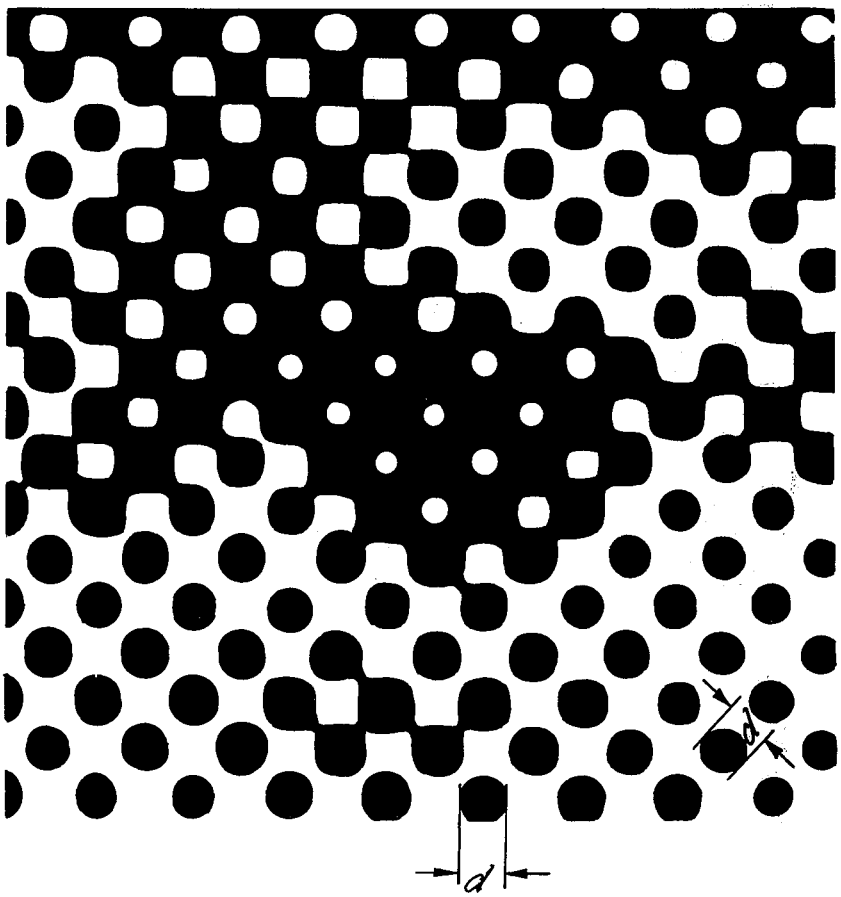
FIG. 6 is a fragmentary frontal view of an image produced by using a polygraphic screen, such image being employed in calculating the size and shape of the platelets employed in forming the changeable image in accordance with the invention.
Figure 8:
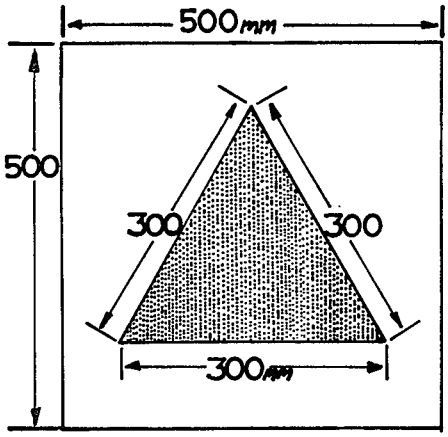
Figure 9:
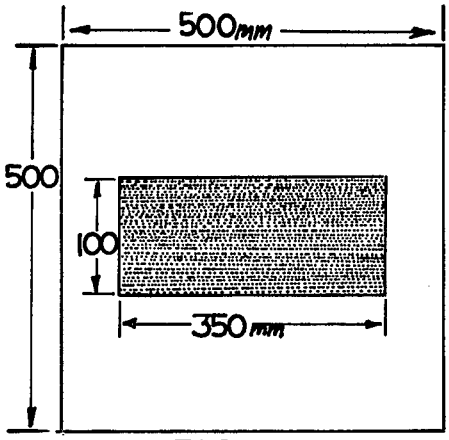
Figure 8A:
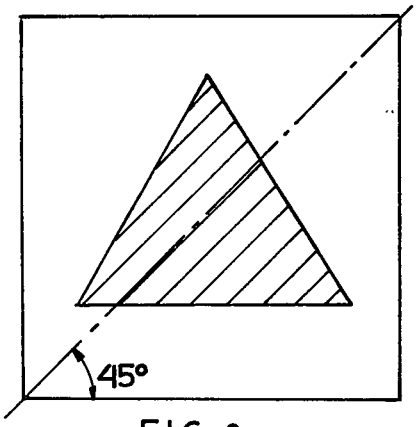
Figure 9B:
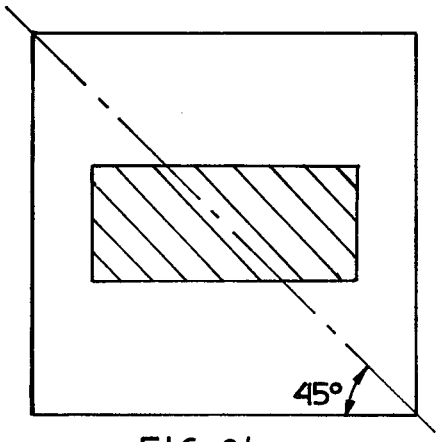
Figure 10:
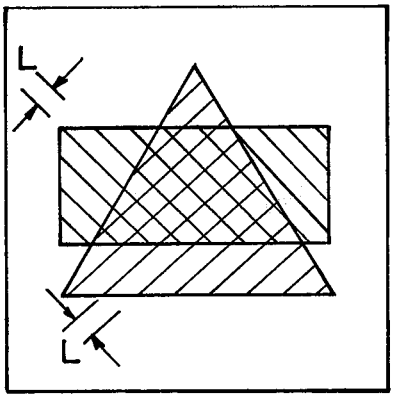
Figure 11:
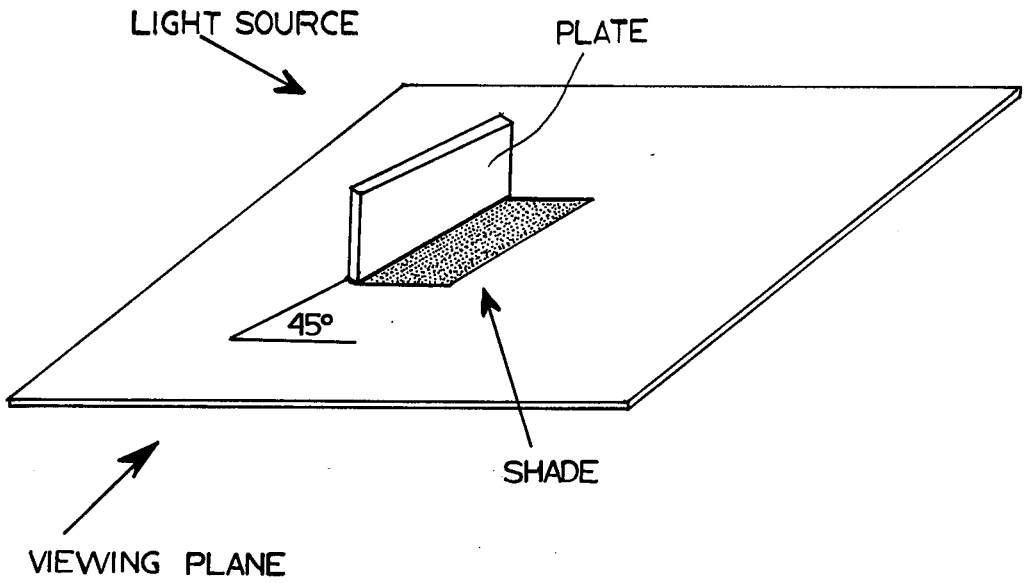
Figure 12:
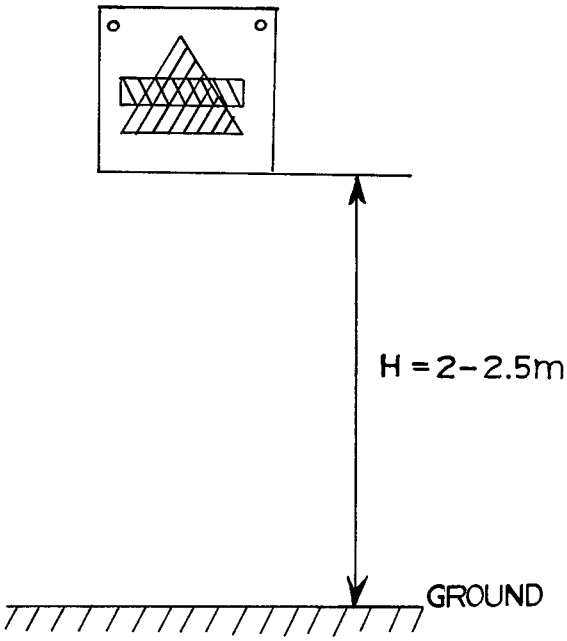

Two black-white graphics or two non-color photographs submitted to screening using a polygraphic screen, serve as an original for the realization of two images on one and the same plane (see FIG. 6).

The transition between the polygraphic screen and shady screen is accomplished as follows (FIG. 3): the area of the screen points of the image shown in FIG. 6 is calculated using the equation $F=\pi d^2/4$ where F denotes the area of the point in (in $mm^2$), d is the mean diameter of the point (in mm). The area F of the point is set equal to the area of a square with side a, wherefrom the side a of the square is obtained, taking into account the equality of the two areas. In fact, a is the length of the base of the platelet, which platelet at a given height would project itself as a shadow of an area adequate to the corresponding point of the image obtained according to the method of polygraphic screen, as it is shown in FIG. 6. The height of the platelet is determined using the equation $h=a \text{ tg } \beta$, where h denotes the height of the platelet in mm; a is the side of the square in mm and is equal to the length of the shadow at an angle of incidence of the sunbeams $\beta$.

With an angle of incidence of the sunbeams as given above and determined using a trigonometric dependence, the length of the projected shadow is determined at the moment of calculation of the side of 20×20 mm square and at 7 mm height of the edge, thus $$7/20=0.3500$$

$$\beta=19°18^1$$

or, in other words, each screen cell (FIG. 6) turns into a shady screen cell (FIG. 3) obtained using a platelet of a width B and height h, which are calculated using the approach given here above.

When the suhbeams incline in the direction of arrow S, the platelet 21 (FIG. 4) draws a shady screen cell B of the first image. The second screen cell is not visible because the platelet 20 projects itself as a thin line C, whose area is negligible in comparison with the area of the shadow thrown by the platelet 21. During the afternoon, when the sunbeams incline in the direction $S^1$, the shadow thrown by the platelet 2l is in the form of a thin line D, which is not visible, while the shadow of the platelet 20 is of an area A corresponding to the screen cell of the second image.

As it will be seen from FIG. 6, in polygraphic screening, the images are obtained as points and their mean diameters d can be determined by measurement. On this basis, the analytical dependences are deduced, which enable, when originating only from the mean diameter of the screen points of the two screen polygraphic images, both the height h and width of the platelets, which draw in a screen manner the images on one and the same plane of the field of vision, to be determined as follows:

$$h_1 = \frac{\pi d_1}{10} \text{ mm}; B_1 = 09\ d_1 \text{ mm}; h_2 = \frac{\pi d_2}{10} \text{ mm}; B_2 = 09\ d_2 \text{ mm}$$

where $h_1$, $B_1$ are the height and width, respectively, of the platelet used for creating the first image; and $h_2$, $B_2$ are the height and width, respectively, of the platelet used for creating the second image.

Although the invention is illustrated and described with reference to one preferred embodiment thereof, it is to be expressly understood that it is in no way limited to the disclosure of such preferred embodiment but is capable of numerous modifications within the scope of the appended claims.

I claim:

1. A device displaying a changeable image, said device comprising a screen having a viewing plane with components forming images mounted thereon, the components being platelets made of a rigid opaque material and being fixedly attached in rows extending in two mutually perpendicular directions each forming an angle of 45° with the horizon, the platelets extending in the respective directions being different in both size and shape, such sizes and shapes being determined so as to form a different image in each direction by means of shadows projected by said platelets.

2. A device according to claim 1, wherein the platelets have two legs and are of L-shape, one of the legs lying in face-to-face contact with the screen, and attached thereto and the other leg extending outwardly from the screen at right angles thereto.

3. A method of producing a device displaying a changeable image according to claim 1, comprising screening two drawn graphics or black and white photographs by using a polygraphic screen, thereafter calculating separately the areas of the screen points and setting each area equal to the area of a square, the side of said square being the length of the platelet's base, determining the height of the platelets analytically for an angle of 19°–25°, and the platelets having sizes thus determined being arranged, according to the polygraphic originals, in screen cells with an angle of 90° therebetween, the area of the shadow thrown by the first set of the platelets corresponding to the area of the screen point of the first image, and the area of the shadow thrown by the second set of platelets which are disposed perpendicular to the first platelets, corresponding to the area of the screen point of the second image.

* * * * *